US005100191A

United States Patent [19]

Detrick et al.

[11] Patent Number: 5,100,191

[45] Date of Patent: Mar. 31, 1992

[54] ZIPPER PULLER

[76] Inventors: Terry L. Detrick, P.O. Box 92; Robert W. Lucous, 1029 Stonyridge, both of Troy, Ohio 45373

[21] Appl. No.: 665,821

[22] Filed: Mar. 7, 1991

[51] Int. Cl.[5] ..... A44B 19/24

[52] U.S. Cl. ..... 294/3.6; 24/429; 132/75.6; 294/2

[58] Field of Search ..... 294/2, 3.6, 24–26; 7/162; 24/381, 385, 390, 429, 431; 132/73, 75.3, 75.6; 223/111; D11/221

[56] References Cited

U.S. PATENT DOCUMENTS

| | | | |
|---|---|---|---|
| D. 207,628 | 5/1967 | Zern et al. . | |
| D. 280,463 | 9/1985 | Sheahan . | |
| D. 286,461 | 11/1986 | Higgins et al. | D11/221 |
| 1,234,845 | 7/1917 | Williamson | 132/75.6 |
| 1,561,262 | 11/1925 | Martin | 132/75.6 X |
| 2,215,877 | 9/1940 | Johnson | 132/75.6 |
| 2,515,557 | 7/1950 | Haswell . | |
| 2,531,805 | 11/1950 | Clark . | |
| 2,663,588 | 12/1953 | Scheldorfer | 294/3.6 |
| 2,681,492 | 6/1954 | Lackritz | 24/429 X |
| 2,887,751 | 5/1959 | Lamb | 294/3.6 |
| 3,145,041 | 8/1964 | Grolig . | |
| 4,022,506 | 5/1977 | Cloud, Sr. . | |
| 4,788,893 | 12/1988 | Sutton | 294/26 X |
| 4,928,363 | 5/1990 | Easton | 24/390 |
| 4,974,297 | 12/1990 | Akashi | 24/429 |
| 5,008,985 | 4/1991 | Thompson | 294/3.6 X |

FOREIGN PATENT DOCUMENTS

| | | | |
|---|---|---|---|
| 1360193 | 7/1974 | United Kingdom | 294/3.6 |
| 2190706 | 11/1987 | United Kingdom | 294/3.6 |

*Primary Examiner*—Johnny D. Cherry
*Attorney, Agent, or Firm*—Biebel & French

[57] ABSTRACT

A zipper operating device is provided for manipulating a slide fastener having a sliding operator member and a tab member connected to the sliding member. The zipper operating device includes a tang member which may be received within a hole in the tab member whereby the zipper operating device may engage the sliding member for manipulation thereof. The zipper operating device is shaped generally like a key and includes a head portion and a shank portion extending therefrom. A hole is provided in the head portion distal from the shank portion such that the device may be attached to a key ring or key chain.

9 Claims, 2 Drawing Sheets

ZIPPER PULLER

BACKGROUND OF THE INVENTION

This invention relates to a device for facilitating the operation of a slide fastener or zipper and, more particularly, to a device which may be easily grasped and which may be attached to a conventional key ring for convenient storage in association with a set of keys.

Slide fasteners of the type contemplated herein usually include a slide member adapted to force elongated complementary fastener means together when moved in one direction and to spread the complementary fastener means apart when moved in an opposite direction. The slide member is typically provided with a tab hingedly connected to the slide member, which tab is adapted to be grasped by the fingers of an operator for facilitating manipulation of the slide member.

Slide fasteners are commonly used as closure members for garments such as pants. One problem often encountered when manipulating the slide member is the increased resistance to sliding caused by a tight-fitted garment on the wearer such as may result when attempting to zip up tight-fitting jeans.

The problem of manipulating the slide fastener on close-fitting garments is particularly acute for people suffering from arthritis. A common solution for this problem is for the wearer to use a pair of pliers to grasp the tab on the slide member in order to obtain a firm grip for pulling the fastener closed. However, it is not practical to carry such a large tool in order to insure that one may be able to manipulate the fastener when necessary.

Accordingly, there is a need for a device for manipulating the slide member of a slide fastener wherein the device is of a compact structure which may be carried unobtrusively.

SUMMARY OF THE INVENTION

The present invention provides a zipper operating device for manipulating a slide fastener having a sliding operator member and a tab member pivotally connected to the sliding member.

The zipper operating device is formed with a head portion having opposing first and second substantially planar sides which define a peripheral edge of the head portion. An elongated shank is connected to and extends from the peripheral edge of the head portion along a longitudinal axis extending substantially parallel to the planar sides.

A tang portion extends from the shank substantially perpendicular to the longitudinal axis of the shank and is dimensioned to be received within a hole in the tab member.

The head portion includes means defining a substantially circular hole adjacent to the peripheral edge and distal from the point where the shank portion is connected to the peripheral edge. The hole is dimensioned to receive a key ring or chain. In addition, the head portion may be formed with a generally octagonal or circular shape and the shank may be formed with a dimension similar to that of a key shank such that the device of the present invention may be compactly carried on a key ring in association with a conventional set of keys.

Further, the zipper operating device may be provided with a rough planar surface formed on a side of the shank such that the rough surface may be used as a fingernail file for manicure touch ups.

Other objects and advantages of the invention will be apparent from the following description, the accompanying drawings, and the appended claims.

DETAILED DESCRIPTION OF THE PREFERRED EMBODIMENT

Figure 1:
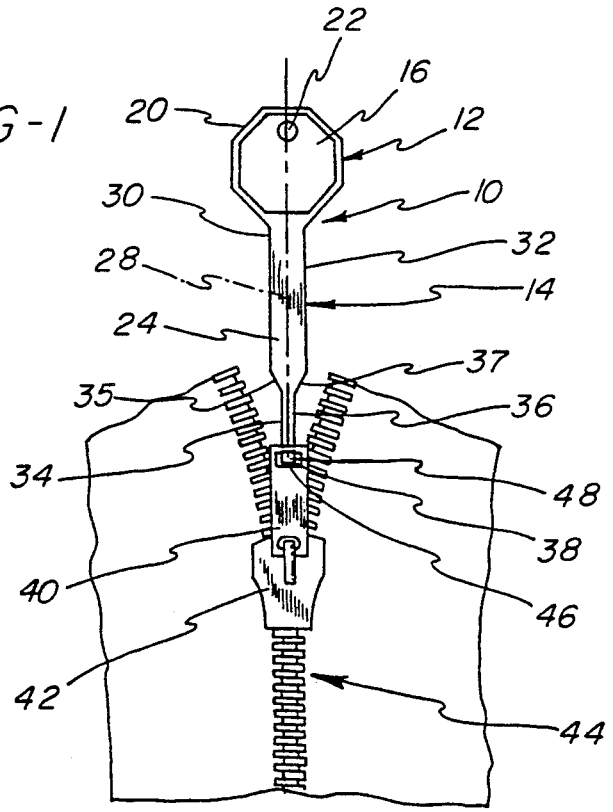
FIG. 1 is a front view of the device of the present invention operatively connected to a slide fastener.

Referring initially to FIG. 1, a device incorporating the principles of the present invention is designated generally as 10 and includes a head portion 12 and a shank portion 14. The head portion 12 includes first and second substantially planar sides 16 and 18 located at the front and rear, respectively, of the device (see FIG. 2).

The first and second sides 16, 18 define a peripheral edge 20 of the head portion 12. The peripheral edge portion 20 extends substantially perpendicular to the planar sides 16 and 18.

The head portion 12 is further provided with means defining a hole 22 therethrough. The hole 22 is located adjacent to the edge 20 at a location distal from the point where the shank portion 14 connects to the head portion 12.

Figure 3:
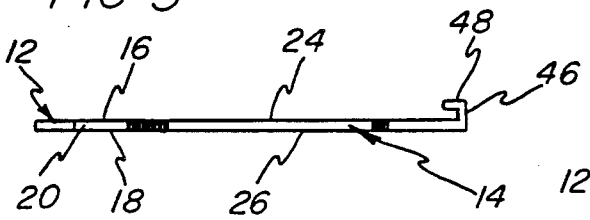
FIG. 3 is an elevational view taken from the side of the device.

Referring to FIG. 3, the shank portion 14 includes first and second substantially planar sides 24 and 26 formed generally contiguous with the first and second sides 16, 18, respectively, of the head portion 12. As seen in FIG. 1, the shank portion 14 defines a longitudinal axis 28 thereof extending through the head portion 12 and passing through the hole 22.

The shank portion 14 further includes first and second opposed edges 30, 32 defining a first width, and third and fourth opposed edges 34, 36 defining a second width of the shank portion 14. The edges 30, 34 are connected by a first angled or tapered transition edge 35, and the edges 32, 36 are connected by a second tapered transition edge 37. The first width of the shank portion 14 is dimensioned such that it is smaller than a width measured diametrically across the head portion 12, and the second width is dimensioned to be smaller than the first width. The second width is further dimensioned to be received within a hole 38 formed in a tab member 40 which is pivotally connected to a sliding member 42 of a slide fastener 44, as seen in FIG. 1.

Figure 4:
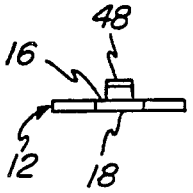
FIG. 4 is an elevational view taken from an end adjacent to the head portion of the device.
Figure 5:
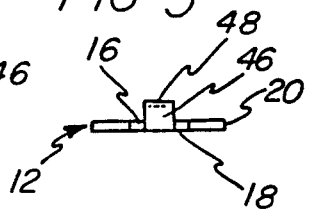
FIG. 5 is an elevational view taken from an end adjacent to the tang member of the device.
Figure 7:
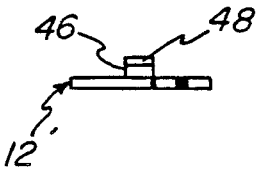
FIG. 7 is an elevational view taken from an end adjacent to the head portion of the device of FIG. 6.
Figure 6:
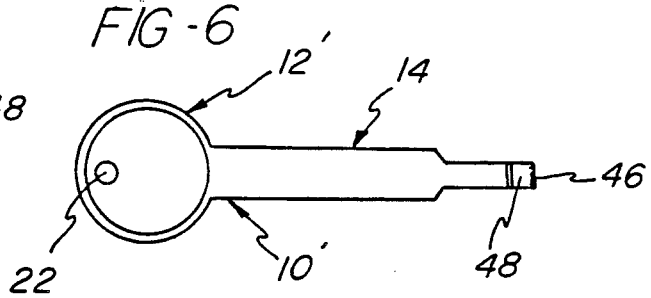
FIG. 6 is a front view of an alternative embodiment of the device.
Figure 8:
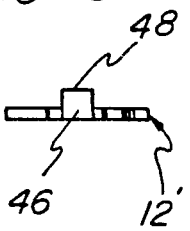
FIG. 8 is an elevational view taken from an end adjacent to the tang member of the device of FIG. 6.
Figure 9:
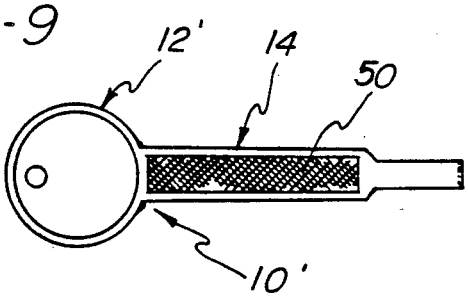
FIG. 9 is a back view of the device of FIG. 6.
Figure 10:
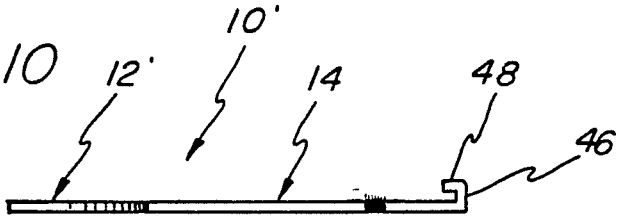
FIG. 10 is an elevational view taken from the side of the device of FIG. 6.

As shown in FIGS. 3–5, a tang member 46 is provided at the end of the shank portion 14 and extends substantially perpendicular to the longitudinal axis of the shank portion 14 and is dimensioned to be received within the hole 38 of the tab 40. In addition, an end portion 48 extends from the tang 46 toward the head portion 12 and acts to prevent the tang 46 from slipping out of the hole 38 during use of the device 10.

Figure 2:
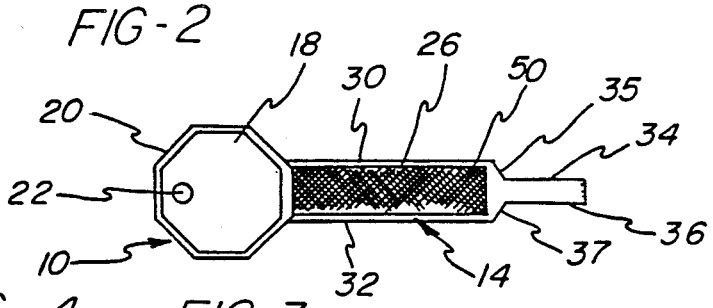
FIG. 2 is a back view of the device.

Referring to FIG. 2, a fingernail file 50 may be provided on one of the planar surfaces of the shank portion 14 and may be used for manicure touch ups. The fingernail file 50 is preferably located on the back side 26 of the shank portion 48 and is formed as a roughened planar surface which preferably includes a plurality of file teeth.

In the embodiment described above, the head portion 12 has been depicted as a generally octagonal-shaped head. However, the head may be provided with other shapes generally found on keys such as the circular shape 12' shown on an alternative embodiment 10' of the device in FIGS. 6–10. The particular shapes of the head portion 12, 12' may be selected with reference to a group of keys on a key ring or key chain with which the device 10 may be placed in association.

The wide head portion 12, 12' provides an easily gripped surface for grasping the device 10, 10' during manipulation of a slide fastener, and a hook-shaped tang is provided for firmly grasping the tab of the sliding member. Thus, an operator may easily pull the sliding member to close the fastener without relying on a large amount of frictional force between the operator's fingers and the tab which is typically necessary for closing tight fitting garments.

Further, the present invention provides an easily transported device which may be unobtrusively carried with a set of keys, and additionally provides a readily available manicure file.

While the forms of apparatus herein described constitute preferred embodiments of the invention, it is to be understood that the invention is not limited to these precise forms of apparatus, and the changes may be made therein without departing from the scope of the invention which is defined in the appended claims.

What is claimed is:

1. A zipper operating device for manipulating a slide fastener having a sliding operator member and a tab member connected to said sliding member, said tab member having means defining a hole therein, said zipper operating device comprising:

a head portion having opposing first and second substantially planar sides, said substantially planar sides defining a peripheral edge of said head portion;

an elongated shank portion connected to said peripheral edge of said head portion, said shank portion defining a longitudinal axis extending substantially parallel to said first and second substantially planar sides, said shank portion including first and second substantially planar sides formed generally contiguous with said first and second sides, respectively, of said head portion, said shank portion further including opposed edge portions joining said sides of said shank portion, said edge portions defining first and second widths, said edge portions defining said first width being parallel to each other and said edge portions defining said second width being parallel to each other, said first width being smaller than a width of said head portion and said second width being smaller than said first width;

a tang portion extending from said second width of said shank portion and located distal from said first width, said tang portion extending substantially perpendicular relative to said longitudinal axis and perpendicular to said first and second planar sides of said head portion and being dimensioned to be received within the hole in said tab member; and means defining a substantially circular hole in said head portion adjacent to said peripheral edge and distal from said shank portion.

2. The device of claim 1, wherein said head portion is substantially octagonal in shape and said hole is aligned with said longitudinal axis and is located diametrically opposite from the elongated shank portion connection to said peripheral edge of said head portion.

3. The device of claim 1, wherein said head portion is substantially circular in shape and said hole is aligned with said longitudinal axis and is located diametrically opposite from the elongated shank portion connection to said peripheral edge of said head portion.

4. The device of claim 1, wherein additional edge portions are provided forming a tapered transition between said edge portions forming said first and second widths.

5. The device of claim 1, wherein said tang portion includes an end portion extending toward said head portion such that said tang portion is formed with a hook shape to facilitate retention of said tang portion within said hole in said tab member.

6. The device of claim 1, wherein one of said sides of said shank portion is formed with a rough surface forming a fingernail file thereon.

7. A zipper operating device for manipulating a slide fastener having a sliding operator member and a tab member connected to said sliding member, said tab member having means defining a hole therein, said zipper operating device comprising:

a head portion having opposing first and second substantially planar sides, said substantially planar sides defining a peripheral edge of said head portion;

an elongated shank portion connected to said peripheral edge of said head portion, said shank portion definging a longitudinal axis extending substantially parallel to said first and second substantially planar sides, said shank portion including first and second substantially planar sides formed generally contiguous with said first and second sides, respectively, of said head portion, said shank portion further including opposed edge portions joining said sides of said shank portion, said edge portions defining first and second widths, said edge portions defining said first width being parallel to each other and said edge portions defining said second width being parallel to each other, said first width being smaller than a width of said head portion and said second width being smaller than said first width;

a tang portion extending from said second width of said shank portion and located distal from said first width, said tang portion extending substantially perpendicular relative to said longitudinal axis and perpendicular to said first and second planar sides of said head portion and being dimensioned to be received within the hole in said tab member;

means defining a substantially circular hole in said head portion adjacent to said peripheral edge and distal from said shank portion; and said shank portion including a rough planar surface forming a fingernail file on said shank portion wherein said rough planar surface is formed on said first planar side of said shank portion.

8. The device of claim 7, wherein said rough planar surface is located on said elongated shank portion opposite from said tang portion.

9. The device of claim 7, wherein additional edge portions are provided forming a tapered transition between said edge portions forming said first and second widths.

* * * * *